US007806044B2

(12) United States Patent
Lin

(10) Patent No.: US 7,806,044 B2
(45) Date of Patent: Oct. 5, 2010

(54) TEA BAG CUP LID

(76) Inventor: Shin-Shuoh Lin, 27022 Falling Leaf Dr., Laguna Hills, CA (US) 92653

( * ) Notice: Subject to any disclaimer, the term of this patent is extended or adjusted under 35 U.S.C. 154(b) by 527 days.

(21) Appl. No.: 11/897,696

(22) Filed: Aug. 31, 2007

(65) Prior Publication Data

US 2009/0056556 A1 Mar. 5, 2009

(51) Int. Cl.
*A47J 31/00* (2006.01)
*B65D 51/18* (2006.01)

(52) U.S. Cl. ..... 99/321; 99/322; 99/323; 220/711; 220/713; 220/254.8

(58) Field of Classification Search ..... 99/321, 99/322, 317, 323; 220/711, 712, 713, 254.1, 220/254.7, 254.8
See application file for complete search history.

(56) References Cited

U.S. PATENT DOCUMENTS 1,785,878 A * 12/1930 Schachter ..... 99/295
2,995,998 A * 8/1961 Howland ..... 99/321
3,799,408 A 3/1974 Palmer
4,625,884 A 12/1986 Zimmermann
4,754,888 A 7/1988 Letsch
4,871,077 A * 10/1989 Ogden et al. ..... 215/365
D307,229 S 4/1990 Grolman
5,318,791 A * 6/1994 Millman et al. ..... 426/431
5,454,482 A * 10/1995 Simon ..... 220/713
5,653,362 A 8/1997 Patel
5,680,951 A * 10/1997 Feltman et al. ..... 220/253
5,918,761 A 7/1999 Wissinger
5,968,618 A 10/1999 Miller
6,269,984 B1 8/2001 Murakami
6,314,866 B1 * 11/2001 Melton ..... 99/322
6,505,752 B1 1/2003 Rolfes et al.
6,659,302 B2 * 12/2003 Lin ..... 220/254.8
7,299,940 B2 * 11/2007 Portman et al. ..... 220/712

* cited by examiner

*Primary Examiner*—Reginald L Alexander
(74) *Attorney, Agent, or Firm*—Gordon K. Anderson

(57) ABSTRACT

A lid (10) is taught for use with a cup to brew tea using a tea bag which incorporates a lid body (24) having an access opening (26) therein and apertures (28) located through the body for drinking tea from the lid. A resilient stopper (38) is disposed within the access opening in the lid, holding the tea bag string (36) between the stopper and the access opening, permitting the tea bag (22) to be initially immersed in hot water within the cup for brewing with the capability of retaining the tea bag string when the tea bag is manually drawn upward away from the tea after brewing. The invention allows brewed tea to be consumed through the lid body without of removing the tea bag until any time after drinking the brewed tea. A lip seal (46) is disposed around the lid body for gripping an inside diameter of the cup while maintaining a firm grasp on the cup.

16 Claims, 3 Drawing Sheets

TEA BAG CUP LID

TECHNICAL FIELD

The present invention relates to a lid for cup in general. More specifically to a lid resiliently interfaced with a cup with the lid having apertures within and a removable stopper capable of retaining a tea bag string, such that a tea bag may be disposed within the cup for brewing and pulled upwardly away from the brew for drinking through the apertures.

BACKGROUND ART

Previously, many types of cup lids have been used in endeavoring to provide an effective means to cover a cup while permitting access without removing the lid.

The prior art listed below did not disclose patents that possess any of the novelty of the instant invention; however the following U.S. patents are considered related:

| U.S. Pat. No | Inventor | Issue Date |
|---|---|---|
| 4,629,088 | Durgin | Dec. 16, 1986 |
| 5,197,624 | Dodaro | Mar. 30, 1993 |
| 5,253,781 | Van Melle et al. | Oct. 19, 1993 |
| 5,509,568 | Warren et al. | Apr. 23, 1996 |
| 5,657,898 | Portman et al. | Aug. 19, 1997 |
| 6,089,397 | Van Melle | Jul. 18, 2000 |
| 7,246,716 B2 | Durdon | Jul. 24, 2007 |

Durgin in U.S. Pat. No. 4,629,088 teaches a beverage container lid that includes a foldable flap which may be opened to allow the user to drink from a beverage container. A recess in the lid receives the opened flap and firmly secures the flap in an open position. The recess includes a pair of detents on either side or an overhang at one end which cooperate to hold the flap firmly within the recess.

U.S. Pat. No. 5,197,624 issued to Dodaro is for a cup lid having a peripheral flange to fit over cup rim and a central portion containing a reclosable access flap movable between an open and closed position. A pull tab is formed on one end of the flap and a hinge on the other. The closure flap engages a first retainer element to releasably retain the reclosable access closure flap in the open position.

Van Melle et al. in U.S. Pat. No. 5,253,781 discloses a disposable volume-extending drink-through lid for hot and cold beverages that extends beyond the upper edge of a drinking cup. The lid may be integrally formed by thermoforming to include a cup engaging section allowing a consumer to drink without leakage or spills while moving or in a moving vehicle.

Warren et al. in U.S. Pat. No. 5,509,568 teaches a molded plastic lid of the drink-through type for use with a conventional beverage cup. The lid has a rim, a raised crown portion and a top. The top is flat and is formed with a recess extending laterally to the side walls. The recess exhibits a structure which may be depressed into a stable inverted condition which provides an enlarged drink-thorough aperture immediately adjacent the side wall.

U.S. Pat. No. 5,657,898 issued to Portman et al. is for a cover having a chamber for retaining a porous filter bag, such as a tea bag. The cover has an upwardly extending protrusion forming a retaining chamber. The protrusion has an aperture enabling passage of the drawstring of the tea bag. An opening, closed by a removable lift tab is formed in the container cover for access to the contents and the user withdraws the tea bag from the liquid contents into the retaining chamber by pulling the drawstring thorough the aperture with the aperture resiliently grasping the drawstring. The container cover and filter bag are used and discarded without causing direct handling of the bag.

Durdon's U.S. Pat. No. 7,246,716 B2 teaches a disposable cup lid for covering a drinking cup. The cup has a portion having a drinking access port, a condiment opening, a rim portion, a reclosable and tearable fold-back condiment tab, a hinge, a post and a recess. The cup lid is structured such that when the opening is not in use it is closable by the condiment tab.

For background purposes and as indicative of the art to which the invention is related reference may be made to the remaining cited patent issued to Van Melle in U.S. Pat. No. 6,089,397.

DISCLOSURE OF THE INVENTION

In the past the use of infusion tea bags for brewing tea in a cup has been popular in this country for many decades. Normally a tea bag is placed in a cup and hot water is poured over the bag, allowed to steep the flavor from the bag until the desired strength is achieved and then the bag is removed with an attached string and placed on a saucer or disposed of. The problem is that the used bag is unsightly and leaves liquid stains on the saucer and if the user does not utilize a saucer after adding hot water to the cup there is no convenient place to store the spent tea bag.

It is therefore a primary object of the invention to have a lid for the cup that permits a tea bag to be stored within the cup during drinking but not directly in the brewed liquid as the tea bag may be pulled upward out of the brewed tea and stored above the liquid level for subsequent disposal.

An important object of the invention is in the ability to keep the brewed tea hot as much of the heat transferred to the atmosphere is lost on the exposed open top surface of the liquid within the cup. A lid also prevents accidental spillage if the cup is bumped or turned at an angle beyond the beyond the normal drinking position.

Another object of the invention provides a convenient method of adding ingredients into the cup without removing the lid itself. This object is achieved by the use of a removable stopper in the center of the lid which permits a tea bag, hot water, flavor additives, such as milk, cream, sugar, synthetic sweetener and lemon to be introduced through the access opening then the stopper may be replaced. Since the lid is in place, the cup may be gently swirled to mix the additives without the necessity of a separate spoon.

Still another object of the invention is that the lid may be used with any cup having the corresponding diameter mating with the lid itself. This feature is particularly beneficial as its utility is not limited to a specific type of cup such as a porcelain china cup, a common mug and particularly a vacuum insulated stainless steel cup or container. Further the lid may be used on a container that is adaptable for use within a vehicle which permits the hot water and tea bag to be added before leaving home with the lid attached. The container may then be stored in one of the holders within the vehicle.

Yet another object of the invention is that there is no modification to the cup required as the only interface is around the inside diameter of the cup at the distal lip.

A further object of the invention is that the spent tea bag does not require handling until it is convenient to remove, as the tea bag may stay within the cup pulled against the inside of the lid until the lid is removed for cup cleaning.

A final object of the invention is that the brewed tea may be consumed by the user at any side of the upwardly extending smooth lip, as a series of circumferential apertures allow the liquid to be distributed at any angle of the cup.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment of a lid 10 for use with a cup 20 to brew tea utilizing a tea bag 22 housed in an infusion filter. The cup 20, is not part of the invention but provides the utility to use the invention, and may be defined as a cup or any type of liquid container, with or without a handle.

Figures 1, 2, 3:
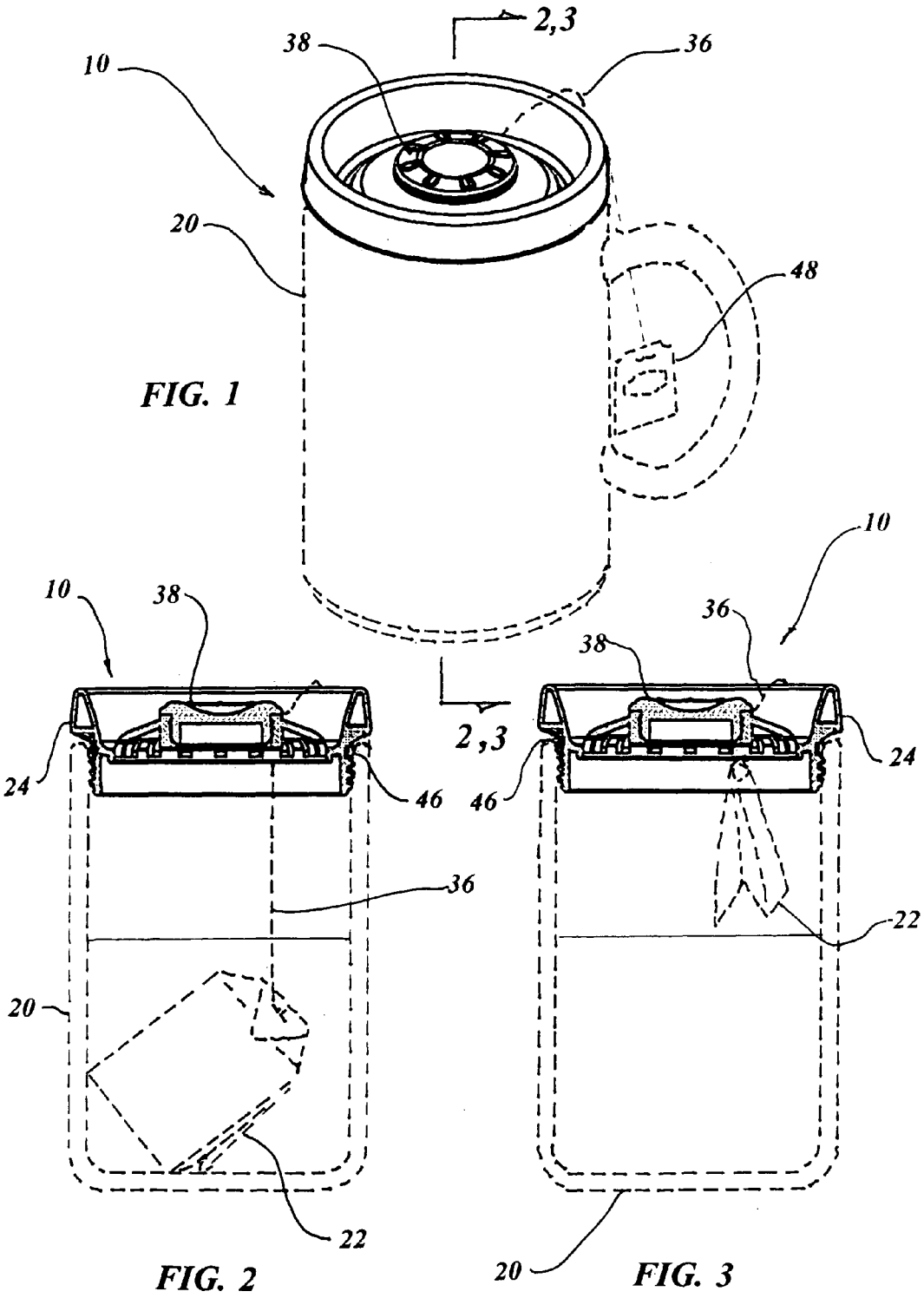
FIG. 1 is a partial isometric view of the lid which is used in conjunction with a tea bag that is attached to a generic cup. The cup is shown dotted as the cup is not part of the invention, with the lid configured in its preferred embodiment.
FIG. 2 is a cross sectional view taken along lines 2-2 of FIG. 1 illustrating a tea bag in contact with hot water brewing within the cup.
FIG. 3 is a cross sectional view taken along lines 3-3 of FIG. 1 illustrating a tea bag drawn upward above the brewed tea within the cup.

This preferred embodiment of the tea bag cup 10 is shown in FIGS. 1 thorough 9 and is comprised of a lid body 24 having an access opening 26 and means for drinking tea through the lid 10, defined as a series of apertures 28 located completely through the lid body 24. The lid body 24 includes a smooth peripheral upper lip 30 permitting drinking at any position around its circumference.

Figure 4:
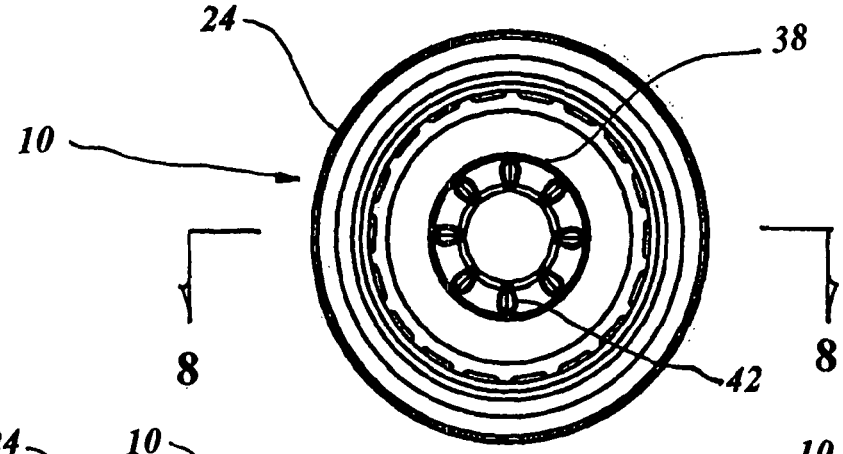
FIG. 4 is a top view of the tea bag cup lid in the preferred embodiment.
Figure 5:
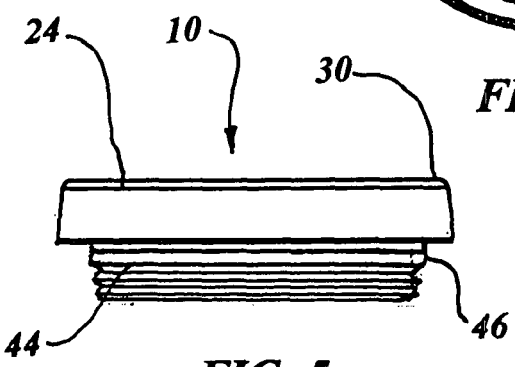
FIG. 5 is a right side view of the tea bag cup lid in the preferred embodiment.
Figure 6:
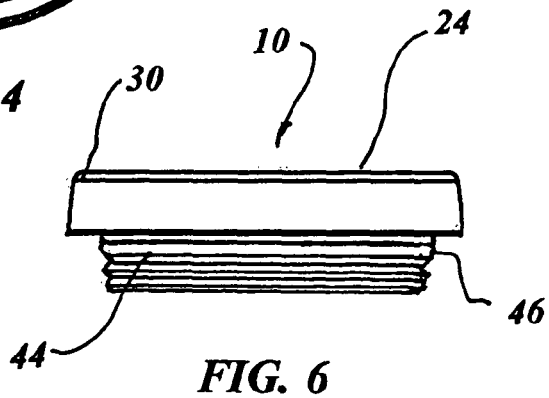
FIG. 6 is a left side view of the tea bag cup lid in the preferred embodiment.
Figure 7:
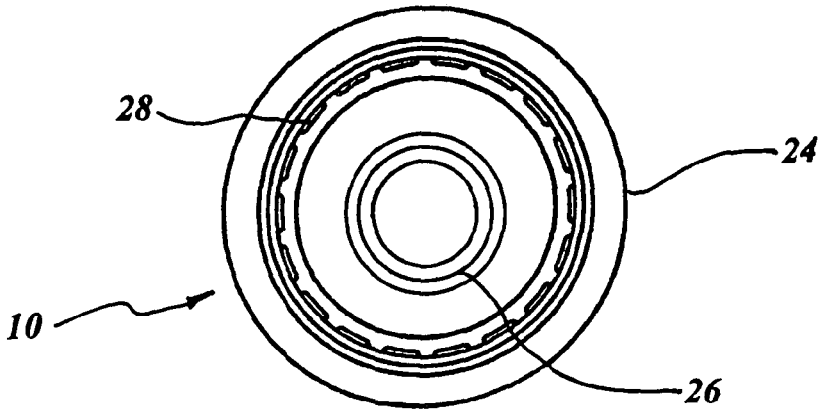
FIG. 7 is a bottom view of the tea bag cup lid in the preferred embodiment.

The lid body apertures 28 preferably extend through the top of the body 24 in a diametrical pattern, as illustrated in FIGS. 4 and 7, such that brewed tea may flow through the apertures 28 at various angular displacements. It has been determined that the angular displacements of the apertures 28 function best when they are at least 20 degrees apart which provides a minimum of eighteen apertures 28.

Figure 9:
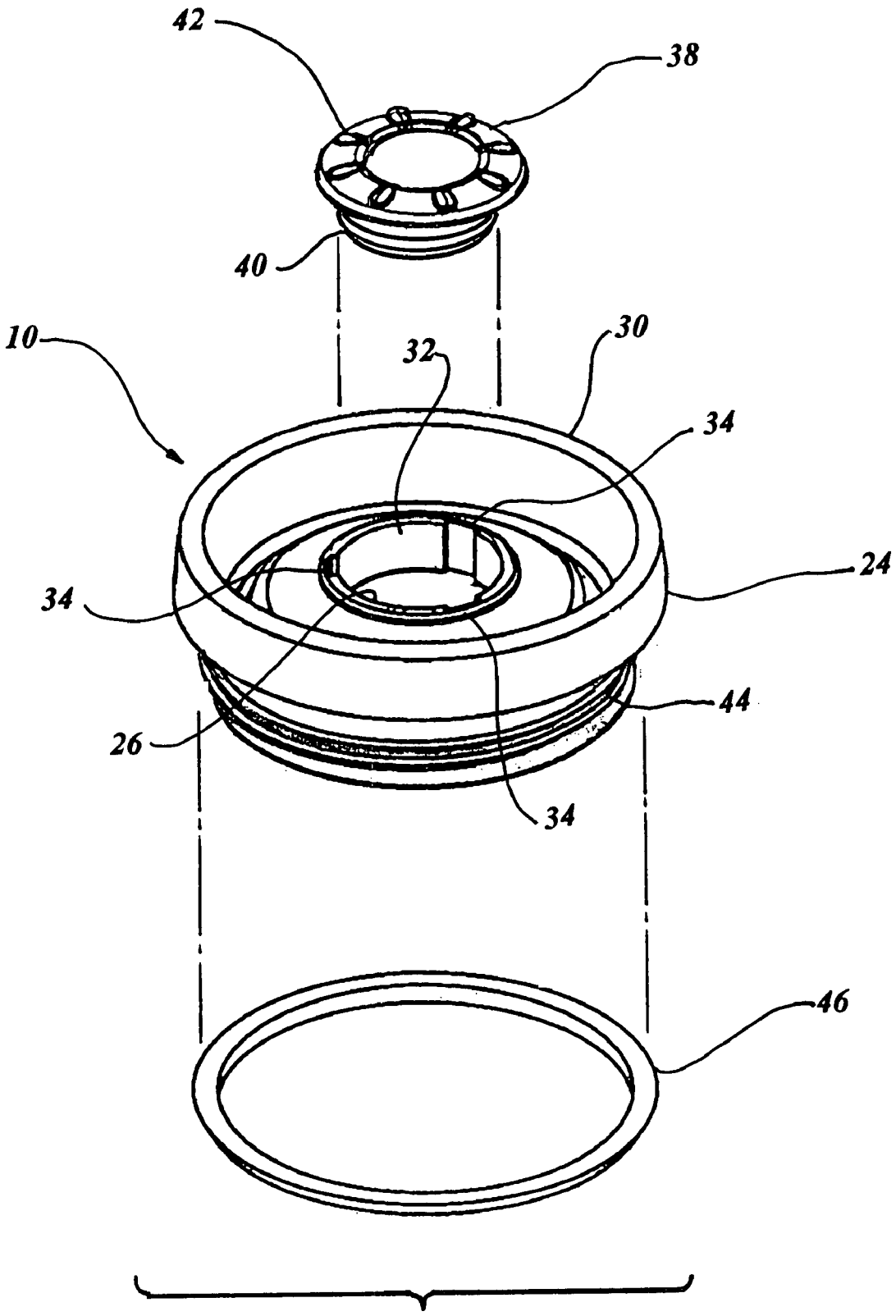
FIG. 9 is an exploded view of the preferred embodiment.

The lid body access opening 26, illustrated best in FIG. 9, incorporates a smooth interior diameter 32 allowing a stopper 38 to be manually urged into the access opening 26 to create a seal. The lid body access opening 26 further includes a number of vertical notches 34 in the smooth interior diameter 32 at a depth corresponding with the diameter of a tea bag string 36 permitting the string to enter one of the notches 34 and be held tightly and yet allowing resistive movement when the stopper 38 is in place within the access opening 26. For convenience, a number of these notches 34 may be spaced evenly around the access opening 26, with at least three being preferred.

The lid body 24 is preferably formed from a material such as polypropylene, acrylic, allyl diglycol carbonate, polycarbonate, polystyrene, polysulfone, polyester sulfone or polyester.

The resilient stopper 38, shown in FIGS. 1-4 and 7-9, is removably disposed within the access opening 26 of the lid body 24 and is used to hold the tea bag string 36 between the stopper 38 and the access opening 26. The stopper 38 in the opening 26 permits the tea bag 22 to be initially immersed in hot water within the cup 20 for brewing, as shown in FIG. 2, and includes the capability of retaining the tea bag string 36 when the tea bag 22 is manually drawn upward after brewing until it contiguously engaging the underside of the lid body 24, as shown in FIG. 3, allowing brewed tea to be consumed through the apertures 28, without the necessity of removing the tea bag 22 until the conclusion of drinking the brewed tea.

In order to fit tightly and retain the tea bag 22 by the string 36 the resilient stopper 38 incorporates a number of integral chevrons 40 formed into a lower portion of the stopper 38 permitting the stopper 38 to resiliently interface with the access opening 26. A number of finger gripping projections 42 extend above a top surface of the stopper 38 and have the utility for assisting in manual removal of the stopper 38 from the access opening 26. The stopper 38 may be made of a thermoplastic material such as acrylic, allyl diglycol carbonate, polycarbonate, polystyrene, polysulfone, polyester sulfone or polyester.

Figure 8:
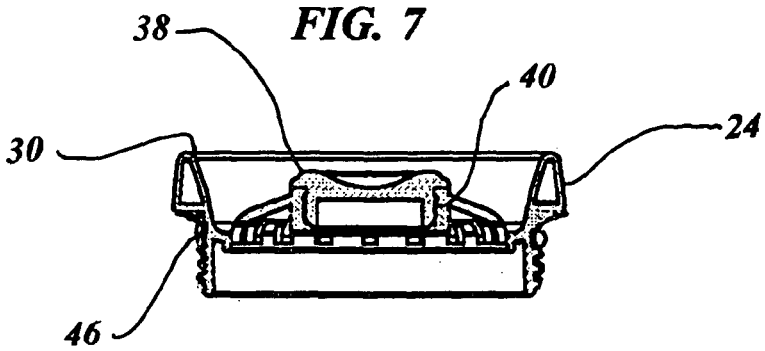
FIG. 8 cross sectional view taken along lines 8-8 of FIG. 4.

The lid body 24 further incorporates a peripheral groove 44, shown best in FIGS. 8 and 9, and is sized to receive a lip seal 46 that mates with the inside diameter of the cup 20 forming a liquid tight closure also the lip seal 46 maintains a firm grasp onto the cup 20 when the lid 10 is pressed into the cup 20. The seal 46 is resilient enough to displace any irregularities in the cup while still providing a liquid tight relationship. The seal 46 has a configuration and is formulated to provide an elastic stretch fit for interfacing tightly with the lid body 24. The lip seal 46 may be made of a material such as Buna N, ethylene propylene, Viton, Teflon, silicone or polyurethane.

When the invention is used hot water is poured over the tea bag 22 in the cup 20, or the tea bag 22 is placed in the cup containing hot water. With the stopper 38 removed the tea bag string 36, including a tab 48 on its distal end, is inserted through the access opening 26 and the mid portion of the string 36 placed in one of the notches 34. The stopper 38 is replaced and then the tea bag 22 is allowed to steep until the brew reaches its desired strength and is then pulled up out of the brewed tea and may remain against the bottom of the lid 10 until the tea bag 22 is disposed of. A flavor additive, such as milk, cream, sugar, synthetic sweetener or lemon may be introduced through the access opening 26 by removing and replacing the stopper 38. Since the lid 10 is already in place, the cup 20 may be gently swirled to mix the additives, when desired. It will be understood that any other procedural steps may be used in brewing the tea also the sequence of when to enter the additives may be changed with equal ease and dispatch.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A lid for use with a cup to brew tea with a tea bag, which comprises:

a lid body having an access opening therein with a smooth interior diameter allowing the stopper to be manually urged into the access opening and create a seal, and a plurality of apertures located completely through the lid body, wherein said lid body access opening having a plurality of vertical notches in the smooth interior diameter at a depth that corresponds with a tea bag string holding the string tightly and yet allowing resistive movement when the stopper is in place within the access opening, a resilient stopper removably disposed within the access opening of the lid body, for holding the tea bag string between the stopper and the access opening, permitting the tea bag to be initially immersed in hot water within the cup for brewing with the capability of retaining the tea bag string when the tea bag is manually drawn upward after brewing, allowing brewed tea to be consumed through the apertures, without the necessity of removing the tea bag until the conclusion of drinking the brewed tea, and a lip seal grippingly disposed around said lid body forming a liquid tight closure on an inside diameter of the cup with the seal maintaining a firm grasp when pressed into the cup.

2. The lid as recited in claim 1 wherein said lid body further having a smooth peripheral upper lip permitting drinking at any position around the circumference of the lid body.

3. The lid as recited in claim 1 wherein said lid body apertures extend through the body top in a diametrical pattern such that brewed tea may penetrate the apertures at various angular displacements.

4. The lid as recited in claim 3 further wherein said angular displacements of the apertures are at least 20 degrees apart providing at least eighteen apertures.

5. The lid as recited in claim 1 wherein plurality of vertical notches are spaced evenly around the access opening.

6. The lid as recited in claim 1 wherein said plurality of vertical notches have a quantity of at least three.

7. The lid as recited in claim 1 wherein said lid body having a peripheral groove sized to receive said lip seal and to mate with an inside diameter of the cup.

8. The lid as recited in claim 1 wherein said lid body is formed from a material selected from the group consisting of polypropylene, acrylic, allyl diglycol carbonate, polycarbonate, polystyrene, polysulfone, polyester sulfone and polyester.

9. The lid as recited in claim 1 wherein said resilient stopper further comprises a plurality of integral chevrons formed into a lower portion of the stopper for resiliently interfacing with the access opening.

10. The lid as recited in claim 1 wherein said resilient stopper further comprises a plurality of finger gripping projections extending above a top surface of the stopper for assisting in removal of the stopper from the access opening.

11. The lid as recited in claim 1 wherein said resilient stopper is comprised of a thermoplastic material selected from the group consisting of acrylic, allyl diglycol carbonate, polycarbonate, polystyrene, polysulfone, polyester sulfone and polyester.

12. The lid as recited in claim 1 wherein said lip seal further comprises a configuration and formulation providing an elastic stretch fit for interfacing tightly with the lid body.

13. The lid as recited in claim 1 wherein said lip seal is comprised of a material selected from the group consisting of Buna N, ethylene propylene, Viton, Teflon, silicone and polyurethane.

14. The cup as recited in the preamble of claim 1 may consist of a cup with a handle.

15. The cup as recited in the preamble of claim 1 may consist of a mug with a handle.

16. The cup as recited in the preamble of claim 1 may be defined as a liquid container without a handle.

* * * * *